US007328925B1

(12) United States Patent
Jenkins

(10) Patent No.: US 7,328,925 B1
(45) Date of Patent: Feb. 12, 2008

(54) GRIPPER FOR PLASTIC BAG HANDLES

(75) Inventor: James H. Jenkins, Winston Salem, NC (US)

(73) Assignee: Bouncing Brain Innovations Season Two Subsidiary 17, LLC, Charlotte, NC (US)

( * ) Notice: Subject to any disclaimer, the term of this patent is extended or adjusted under 35 U.S.C. 154(b) by 0 days.

(21) Appl. No.: 10/407,985

(22) Filed: Apr. 4, 2003

(51) Int. Cl.
*B65D 33/06* (2006.01)

(52) U.S. Cl. ..... 294/159; 294/137

(58) Field of Classification Search ..... 294/137, 294/141, 142, 158, 159, 163, 168, 169, 160, 294/162, 167, 170, 103.1; D9/434, 455; 248/316.1, 340; D3/328; 16/114.1, 428; 383/6, 13, 15, 25, 26, 29
See application file for complete search history.

(56) References Cited

U.S. PATENT DOCUMENTS

| | | | | | |
|---|---|---|---|---|---|
| 2,398,948 | A * | 4/1946 | Martinez | 294/169 |
| 2,521,473 | A * | 9/1950 | Merisuo | 294/158 |
| 2,539,496 | A * | 1/1951 | Towey | 294/153 |
| 2,592,389 | A * | 4/1952 | Budy | 294/158 |
| 3,755,859 | A * | 9/1973 | Solari | 248/317 |
| 4,023,762 | A * | 5/1977 | Batts et al. | 248/340 |
| 4,112,541 | A * | 9/1978 | Tetradis | 294/137 |
| 4,623,185 | A * | 11/1986 | Thomas | 294/159 |
| D325,169 | S | 4/1992 | Montoya | D9/434 |
| 5,181,757 | A * | 1/1993 | Montoya | 294/159 |
| 5,263,755 | A * | 11/1993 | Thompson | 294/137 |
| D358,094 | S | 5/1995 | DeGiacomo, Jr. | D9/439 |
| 5,599,052 | A | 2/1997 | Van Davelaar | 294/159 |
| 5,904,388 | A * | 5/1999 | Seibel | 294/141 |
| 5,921,601 | A * | 7/1999 | Buckles | 294/142 |
| 5,944,178 | A * | 8/1999 | Mao | 248/316.1 |
| 5,957,513 | A * | 9/1999 | Merritt | 294/15 |
| 6,434,803 | B1 * | 8/2002 | Spong | 24/543 |
| D465,719 | S * | 11/2002 | Ditzig et al. | D8/321 |
| 6,711,784 | B2 * | 3/2004 | Walker | 294/166 |
| 6,923,356 | B2 * | 8/2005 | Reynolds | 294/159 |
| 2002/0105798 | A1 * | 8/2002 | Hill | 362/156 |

FOREIGN PATENT DOCUMENTS

| | | | |
|---|---|---|---|
| FR | 002662668 | * 12/1991 | 294/158 |

* cited by examiner

*Primary Examiner*—Saul Rodriguez
*Assistant Examiner*—Paul T Chin
(74) *Attorney, Agent, or Firm*—Tillman Wright, PLLC; James D. Wright; Chad D. Tillman

(57) ABSTRACT

A bag grip includes a movable jaw for securing handles of plastic or other bags therein. A battery powered light is contained within the body of the grip for use at night or other times when artificial light is required. The grip is molded from a conventional durable plastic and will allow the user to easily, manually transport multiple shopping or other bags having handles. A shoulder strap is attached to the body for additional convenience while carrying heavy loads.

11 Claims, 3 Drawing Sheets

GRIPPER FOR PLASTIC BAG HANDLES

FIELD OF THE INVENTION

The invention herein pertains to a device for use while manually carrying filled shopping bags and particularly pertains to a convenient hand grip for carrying multiple shopping bags simultaneously.

DESCRIPTION OF THE PRIOR ART AND OBJECTIVES OF THE INVENTION

Grocery stores and other retail outlets in recent years have increasingly provided lightweight plastic shopping bags for consumer's purchases. Due to the small size of such bags, for example groceries are often placed in three or more bags for each shopper. Standard plastic grocery bags have a pair of extending handles for use. To aid in the manual transportation of loaded shopping bags, various forms of grips, carriers and the like have been devised over the years. Examples of such prior devices are shown in the following U.S. Pat. Nos. Des. 325,169, Des. 358,094, 5,181,757 and 5,599,052.

While all bag carriers have some advantages, it has been found that many of the prior devices are limited to carrying only a very few shopping bags, such as three or four. Certain of the prior devices are susceptible to inadvertent release of the shopping bags and the consequent spilling thereof such as when the carrier is sharply tilted during use. Prior devices also do not employ illumination for the user in dark or night time conditions. Also, when prior devices engage heavily loaded bags, the user cannot readily ease the heavy burden, short of placing the carrier on the ground or other rest location.

Thus, with the problems and disadvantages of prior art bag grips and carriers, the present invention was conceived and one of its objectives is to supply a grip for shopping bag handles which will allow the bag handles to be easily and securely held.

It is another objective of the present invention to provide a bag grip which has accommodations from six to eight shopping bags.

It is still another objective of the present invention to provide a bag grip which has a pivotable jaw to secure the bag handles therein.

It is yet another objective of the present invention to provide a bag grip which includes a battery powered light to assist the user at night.

It is also an objective of the present invention to provide a bag grip having a shoulder strap to lessen the user's burden while carrying heavy bags.

It is still a further objective of the present invention to provide a bag grip which can be molded from a conventional plastics by standard techniques.

It is a further objective of the present invention to provide a bag grip which is easy to operate and relatively inexpensive to manufacture and purchase.

Various other objectives and advantages of the present invention will become apparent to those skilled in the art as a more detailed description is set forth below.

SUMMARY OF THE INVENTION

The aforesaid and other objectives are realized by providing a preferred bag grip having a c-shaped molded body with a handle along the top and a mouth at the bottom joined by a central stanchion. The bottom includes a stationary lower jaw with a series of lateral peaks and valleys which are opposingly positioned to lateral peaks and valleys on the upper jaw when closed. The upper jaw in the preferred form moves or pivots in a vertical direction for raising and lowering, to load and unload shopping bag handles which are received in the valleys. The grip body is sized for easily holding by one hand and includes a non-slip resilient covering for retention purposes. A shoulder strap is attached to the top which allows the user to momentarily release the hand from the grip such as while opening a car door, and prevents having to place the bags on the ground. In the lower part of the stationary jaw a battery operated light is provided with a convenient switch proximate the body handle to allow the user to turn the light on and off as needed.

In use, the movable jaw is first lifted to an open position. Bag handles are then placed within the valleys and the movable jaw thereafter is closed against the stationary lower jaw. The bag grip containing the bags can then be carried to a car or other destination. If the bags are heavily loaded, the shoulder strap can be placed over the user's shoulders to relieve the load from the hand. To remove the bags, the jaw is opened, the loaded bags removed from the grip and placed into, for example a vehicle. Should the grip be used during night or dark conditions, a switch is turned on to allow the light to assist the user in walking, and can further be used to focus on a car door or trunk lock as needed.

The grip can be placed in the vehicle while the bag handles remain therein if desired. Once the consumer arrives at his home or other destination, the grip can be again lifted and carried with the loaded bags to the final destination, such as to a kitchen. There, the moveable jaw of the grip is opened, the bags removed and the grip can be stored for future use.

DETAILED DESCRIPTION OF THE PREFERRED EMBODIMENT AND OPERATION OF THE INVENTION

Figure 2:
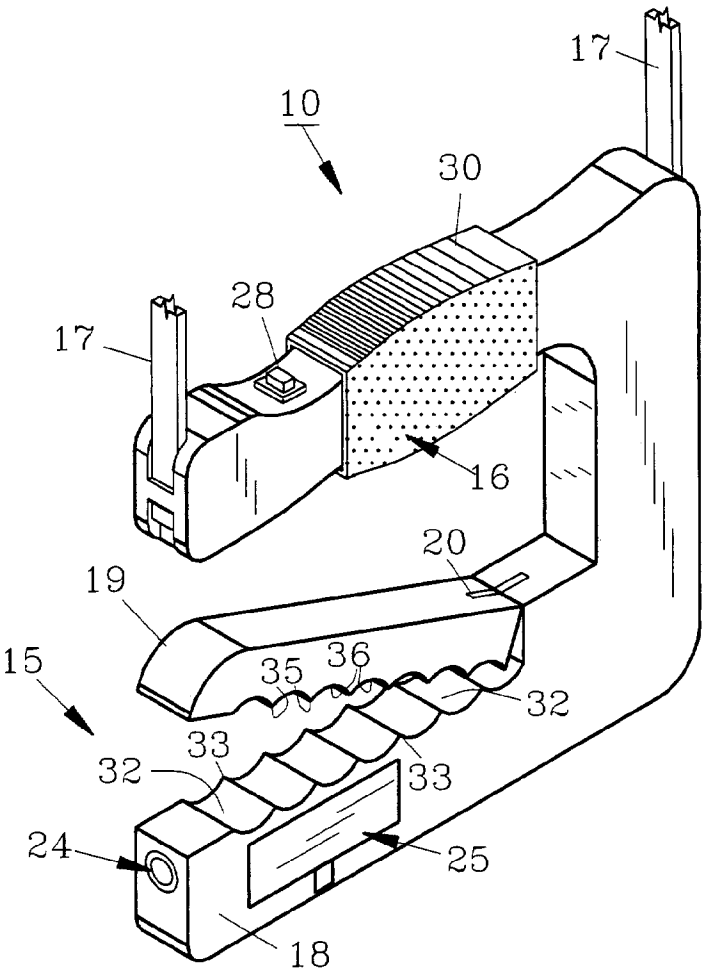
FIG. 2 features a side view of the invention of FIG. 1 with the upper jaw raised for loading purposes.
Figure 1:
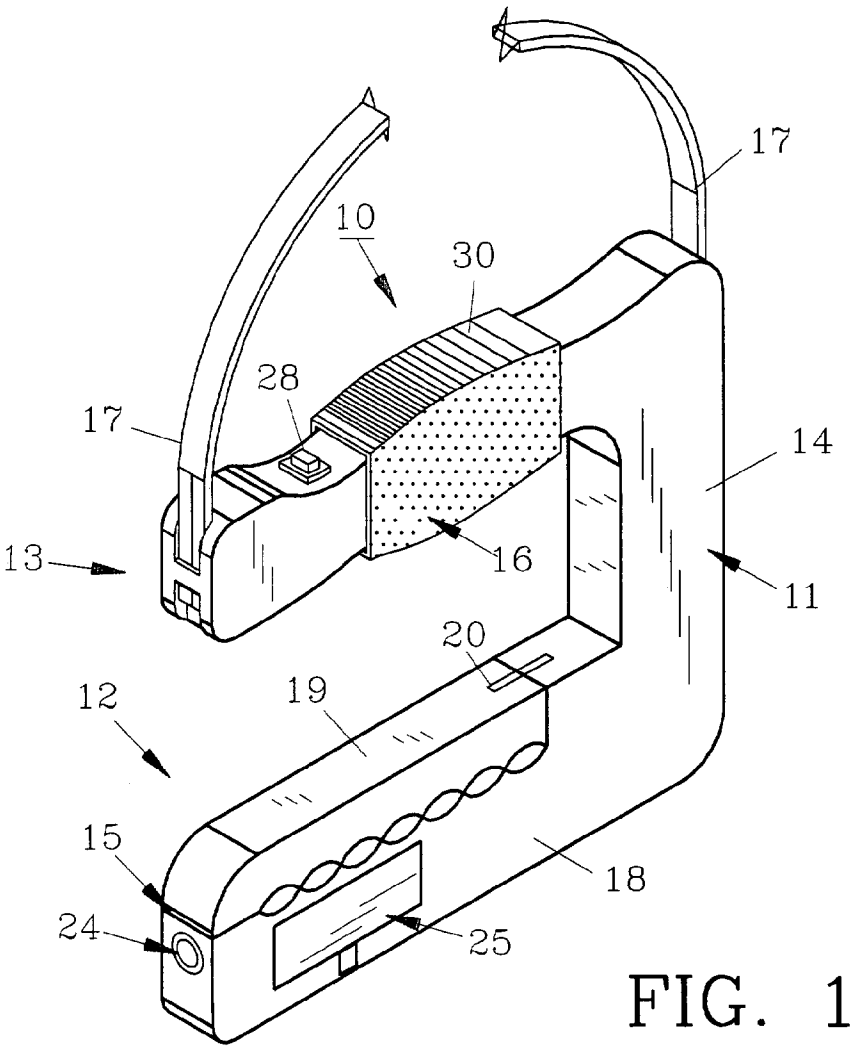
FIG. 1 shows a perspective view of the preferred embodiment of the invention with the shoulder strap fragmented and the upper jaw in a closed posture.
Figure 6:
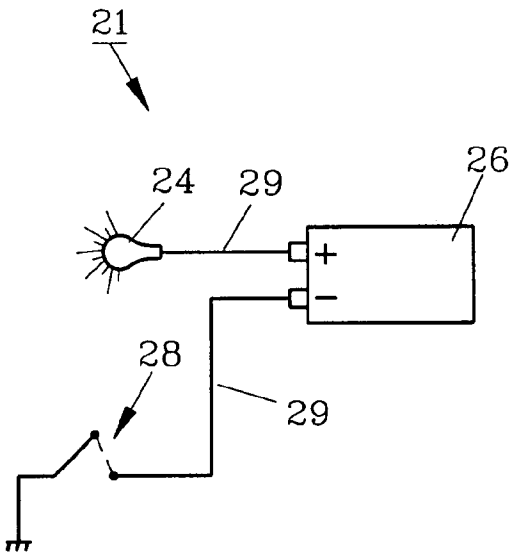
FIG. 6 illustrates a schematic view of the electrical circuitry.

For a better understanding of the invention and its operation, turning now to the drawings, FIG. 1 shows preferred bag grip 10 having a c-shaped body 11 preferably formed from a conventional polymeric material such as by molding. Body 11 includes a bottom 12, top 13 and central stanchion 14, all joined as by integrally molding the same. Top 13 includes body handle 16 as shown in FIGS. 1 and 2. Bottom 12 includes mouth 15 formed by stationary jaw 18 and pivotable jaw 19 affixed thereto, seen raised in FIG. 2 and affixed to hidden hinge 20. Stationary jaw 18 includes battery powered light 24 as shown schematically in circuit 21 seen in FIG. 6. Battery 26 is contained within battery compartment 25 as shown in FIGS. 1 and 2. Switch 28 is connected to lamp 24 by conductors 29 within body 14, shown schematically in FIG. 6. Body handle 16 is covered with a resilient non-slip sleeve 30 which may be formed from foam rubber, plastic, or other suitable materials. Top 13 is also provided with preferred nylon shoulder strap 17, which may be adjustable for assistance while carrying heavily filled bags.

In use, upper jaw 19 is lifted as shown in FIG. 2 and bag handles 80, (FIG. 4) as on for example grocery bags, are placed within valleys 32 of lower jaw 18, as seen in FIG. 2. As further shown, pointed peaks 33 are between valleys 32. As also shown, upper jaw 19 includes pointed peaks 35 and valleys 36 which are opposingly positioned to pointed peaks 33 and valleys 32 of stationary jaw 18 when upper jaw 19 is closed as shown in FIG. 1. As, further shown in FIGS. 1, 3 and 4, upper (movable) peaks 35 or 71 (identified in FIGS. 2 and 5) are in contact with lower (stationary) peaks 33 or 68 (identified in FIGS. 2 and 5) when upper jaw 19 is closed. Upper valleys 36 and lower valleys 32 define lateral channels for securing bag handles 80 therein during carrying.

Figure 3:
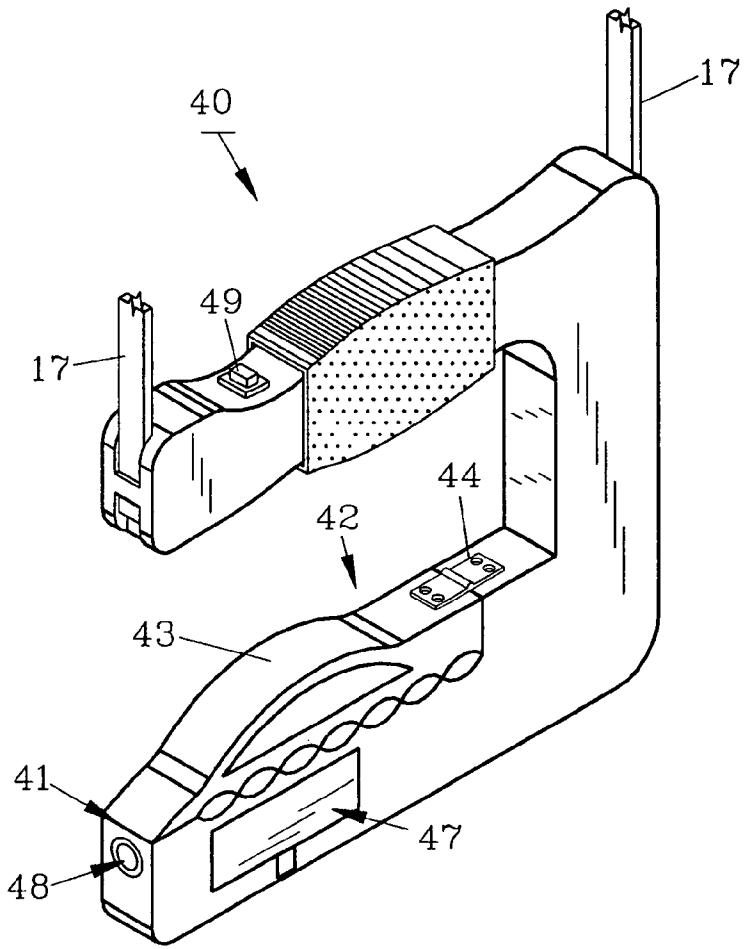
FIG. 3 demonstrates a perspective view of the first alternate embodiment of the invention.

In a first alternate embodiment of the invention as shown in FIG. 3, bag grip 40 includes upper jaw 42 having rail 43 to allow for convenience in opening jaw 42 of mouth 41. Hinge 44 is exposed (whereas hinge 20 is hidden as shown in FIGS. 1 and 2) and allows pivotable jaw 42 to readily, vertically open for accepting bag handles therein. Battery compartment 47 can also be opened for battery replacement for light 48. Switch 49 is similar to switch 28 as shown in FIG. 1 and turns light 48 on and off as needed.

Figure 4:
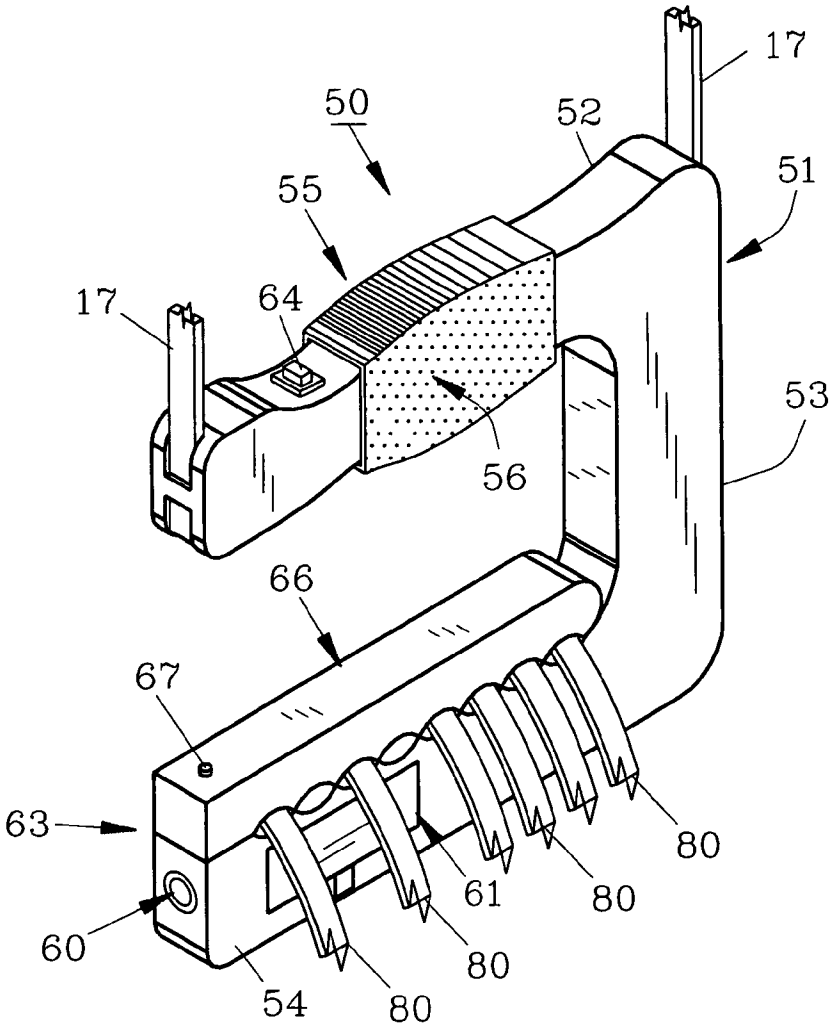
FIG. 4 shows a perspective view of a second alternate embodiment of the invention.

In FIG. 4, a second alternate embodiment of the invention is shown with bag grip 50 having shoulder strap 17 as shown in FIG. 1. Bag grip 50 includes body 51 having top 52, stanchion 53 and bottom 54. Top 52 includes a resilient non-slip cover 55 over handle 56 similar to cover 16 as shown in FIG. 1.

Figure 5:
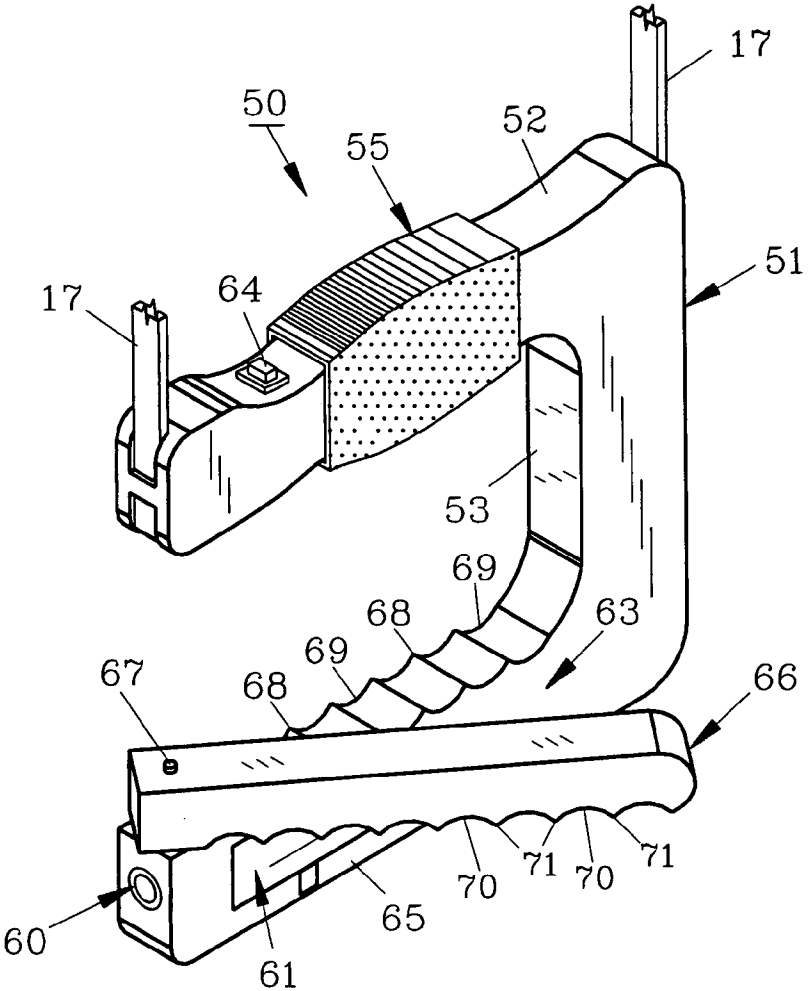
FIG. 5 demonstrates a perspective view of the invention as shown in FIG. 4 with the upper jaw pivoted as in loading or unloading.

Light 60 is powered by batteries contained within battery compartment 61 and is operated by switch 64 shown mounted on top 52 in FIG. 4. Lower jaw 64 of mouth 63 is stationary whereas upper jaw 66 is horizontally pivotable about pivot pin 67. As shown in FIG. 5, upper jaw 66 can be opened by horizontal rotation to allow placement of plastic bag handles 80 therein. Bag handles 80 are placed in valleys 69 of lower jaw 65 opposite valleys 70 of upper jaw 66. Pointed peaks 71 of upper jaw 66 and pointed peaks 68 of lower jaw 65 are opposingly positioned and in contact with each other as shown in FIG. 4 when upper jaw 66 of mouth 63 is closed. While upper jaw 66 and lower jaw 65 provide lateral grooves for eight (8) bags, more or less peaks and valleys could be positioned therealong as required.

In the method of use, a bag grip such as bag grip 10 shown in FIGS. 1 and 2 is opened by pivoting upper jaw 19 vertically as shown in FIG. 2. A series of bag handles 80 of conventional plastic grocery bags are then placed within valleys 32. Upper jaw 19 is then closed and bag grip 10 can be lifted by holding handle 30. Should the load contained within the bag grip be especially heavy, shoulder strap 17 can be placed over the user's shoulder to ease the load. Light 24 can be turned on as required by manipulation of switch 28 during night or other times of insufficient light.

The illustrations and examples provided herein are for explanatory purposes and are not intended to limit the scope of the appended claims.

I claim:

1. A gripper for simultaneously, manually carrying multiple shopping bags, each of the bags having handles comprising: a body, said body being C-shaped, said body comprising a top, a bottom and a central stanchion, said central stanchion attached to said top and to said bottom, said top defining a fixed handle, said fixed handle positioned contiguous said central stanchion, a sleeve, said sleeve covering said fixed handle, said sleeve to prevent slippage and to aid retention of the user's hand, said bottom defining a stationary jaw and a moveable jaw, said stationary jaw and said moveable jaw each defining peaks and valleys, said moveable jaw pivotally attached to said stationary jaw to accommodate loading the bag handles, said moveable jaw being arcuately pivotable above said stationary jaw, said moveable jaw peaks and said stationary jaw peaks being in contact with one another when said jaws are closed, whereby multiple bag handles are maintained separately within said valleys and removable from said gripper when said jaws are open.

2. The gripper of claim 1 wherein said moveable peaks and said stationary peaks are pointed.

3. The gripper of claim 1 further comprising a hidden hinge, said hinge attached to said bottom and to said pivotable jaw, wherein said moveable jaw is positioned above said stationary jaw, and said fixed handle is spaced above said stationary jaw.

4. The gripper of claim 1 wherein said moveable jaw is pivotable vertically above said stationary jaw and below said fixed handle.

5. The gripper of claim 1 wherein said moveable jaw is pivotable horizontally above said stationary jaw.

6. The gripper of claim 1 further comprising a shoulder strap, said shoulder strap attached at the ends of said fixed handle.

7. The gripper of claim 1 further comprising a light, said light attached to said bottom, a switch, said switch connected to said light, said switch attached to said fixed handle, said bottom defining a battery compartment along one side for containing a battery to power said light.

8. The gripper of claim 1 wherein said top is parallel to said bottom, and said central stanchion is substantially perpendicular to said top and to said bottom.

9. A gripper for simultaneously, manually carrying multiple shopping bags, each bag having handles comprising: a c-shaped integrally formed body, said body comprising a top, a bottom and a central stanchion, said central stanchion attached to said top and to said bottom, said top defining a fixed handle, said fixed handle positioned contiguous said central stanchion, a sleeve, said sleeve covering said fixed handle, said sleeve to prevent slippage and to aid retention of the user's hand, a strap, said strap attached to said top, said bottom comprising a movable jaw and a stationary jaw, a hinge, said hinge attached to said movable jaw and to said stationary jaw, said movable and said stationary jaws each defining a plurality of peaks and valleys, said movable jaw pivotally attached to said stationary jaw, said moveable jaw arcuately pivotable above said stationary jaw and below said fixed handle, said moveable jaw openable for loading a bag handle in one of said stationary jaw valleys and thereafter closeable to secure the bag handle, said moveable jaw peaks in contact with said stationary jaw peaks when said jaws are closed to form closed lateral channels between said jaws for separating and maintaining the bag handles therein.

10. The gripper of claim 9 wherein said moveable jaw is pivotable vertically above said stationary jaw.

11. The gripper of claim 9 further comprising a light, said light attached to said bottom, a switch, said switch positioned on said fixed handle proximate said sleeve, said switch in electrical communication with said light for operation of said light.

* * * * *